United States Patent [19]

Sommer et al.

[11] Patent Number: 4,553,498

[45] Date of Patent: Nov. 19, 1985

[54] DEVICE FOR CLAMPING AND TENSIONING AN ELASTIC DOCTOR BLADE

[75] Inventors: Herbert Sommer, Dusseldorf; Gerhard Wohlfeil, Monheim, both of Fed. Rep. of Germany

[73] Assignee: Jagenberg AG, Dusseldorf, Fed. Rep. of Germany

[21] Appl. No.: 598,561

[22] Filed: Apr. 10, 1984

[30] Foreign Application Priority Data

Apr. 18, 1983 [DE] Fed. Rep. of Germany ..... 3313972

[51] Int. Cl.[4] ..... B05C 11/04

[52] U.S. Cl. ..... 118/126; 118/261

[58] Field of Search ..... 118/126, 123, 261; 15/256.51

[56] References Cited

U.S. PATENT DOCUMENTS

| | | | |
|---|---|---|---|
| 3,688,336 | 9/1972 | Costello, Jr. et al. | 118/126 X |
| 4,220,113 | 9/1980 | Wohlfeil | 118/126 |
| 4,375,202 | 3/1983 | Miller | 118/126 X |

FOREIGN PATENT DOCUMENTS

| | | | |
|---|---|---|---|
| 2825907 | 2/1981 | Fed. Rep. of Germany | 118/126 |

*Primary Examiner*—John P. McIntosh

*Attorney, Agent, or Firm*—Sprung, Horn, Kramer & Woods

[57] ABSTRACT

A device for unilaterally clamping an elastic doctor blade into a cutting beam. The tension of the blade is varied in relation to a web of material that is to be coated and that runs over a mating roll. The doctor blade rests against the web of material along a doctor line parallel to the cutting beam. The blade is rigidly supported in its midsection along a line of support that is in fixed position with respect to the web of material parallel to the doctor line. The lower edge of the doctor blade can be displaced with respect to the plane of the doctor line and the line of support. The doctor blade is positioned in a longitudinal recess in the cutting beam. The doctor blade is clamped into the longitudinal recess against an elastic resistance in the cutting beam by means of an elastic pressure-medium hose. The lower edge of the doctor blade is guided toward the line of support when displaced out of the plane of the doctor line and the line of support. The geometric relations in the vicinity of the doctor line accordingly remain as unvaried as possible even when the tension on the doctor blade is varied.

16 Claims, 9 Drawing Figures

FIG. 5
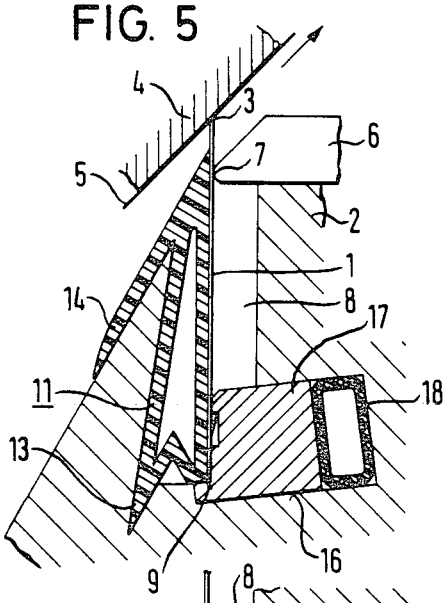
FIG. 6
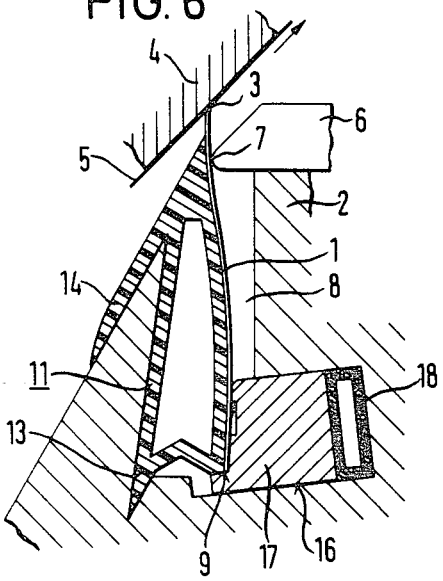
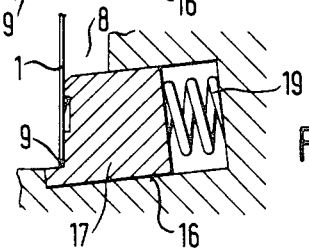
FIG. 7
FIG. 8
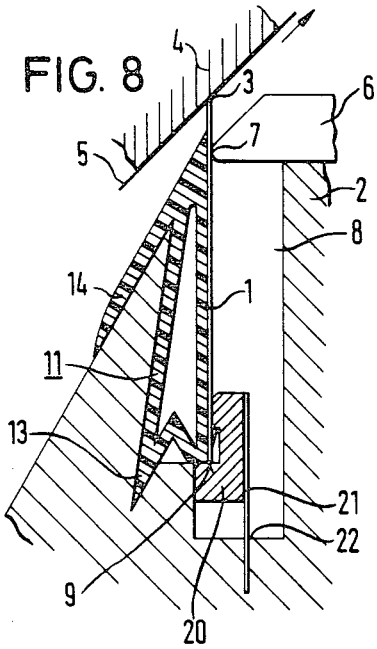
FIG. 9
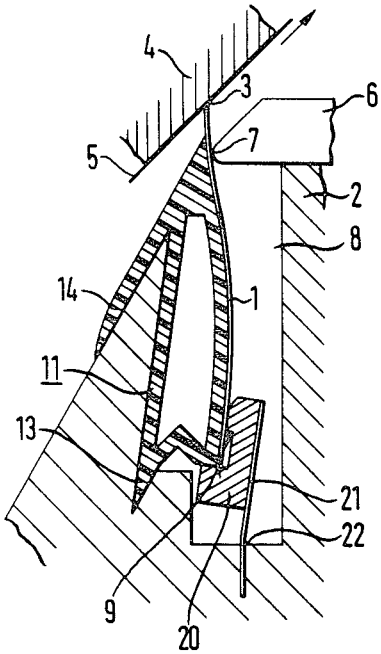

DEVICE FOR CLAMPING AND TENSIONING AN ELASTIC DOCTOR BLADE

BACKGROUND OF THE INVENTION

The present invention relates to a device for unilaterally clamping an elastic doctor blade into a cutting beam and for varying the tension of the blade in relation to a web of material that is to be coated and that runs over a mating roll, whereby the doctor blade rests against the web of material along a doctor line parallel to the cutting beam and is rigidly supported in its midsection along a line of support that is in fixed position invariable with respect to the web of material parallel to the doctor line and the lower edge of the doctor blade can be displaced wth respect to the plane of the doctor line and the line of support.

A device of this type is known from German Auslegeschrift No. 2825907, for example. The doctor blade in that device is clamped into a clamping beam that can be displaced around an acute angle by means of a linear guide toward a plane defined by the untensioned doctor blade. The linear guide represents an approximation of the desired and requisite displacement of the line along which the doctor blade is clamped, which can lead to slight deviations in the geometric relations between the blade and the mating roll when the tension on the blade is varied extremely.

SUMMARY OF THE INVENTION

The object of the present invention is to provide a device of the aforesaid type of an extremely simple design in which the geometric relations in the vicinity of the doctor line remain as unvaried as possible even when the tension on the doctor blade is varied, thus eliminating even existing residual geometric errors when the doctor blade is adjusted.

This object is attained in accordance with the invention (a) in that the doctor blade is positioned in a longitudinal recess in the cutting beam, (b) in that the doctor blade is clamped into the longitudinal recess against an elastic resistance in the cutting beam by means of an elastic pressure-medium hose, and (c) in that the lower edge of the doctor blade is guided toward the line of support when displaced out of the plane of the doctor line and the line of support.

The lower edge of the doctor blade is guided in such a way that the deflections occurring in the doctor blade when it is tensioned by varying the pressure in the elastic pressure-medium hose will no longer affect the geometric relations in the vicinity of the doctor line. The design is extremely simple because the pressure-medium hose is the only element that moves when the tension on the doctor blade is adjusted by varying the pressure.

The lower edge of the doctor blade is guided in a practical way by a rotating element that is positioned eccentric to the plane of the doctor line and the line of support and that rests and rotates against an elastic resistance element.

The lower edge of the doctor blade can also be guided along a bevel in the base of the longitudinal recess and the doctor blade be supported against an elastic resistance element.

The lower edge of the doctor blade can alternatively be guided by an element that is positioned flat against a bevel in the base of the longitudinal recess and that is supported on an elastic resistance element.

It is practical for the elastic resistance elements to be foam rubber elements, elastic hoses, or helical springs.

The lower edge of the doctor blade can also be guided by a holder that can be pivoted subject to spring tension around to pivot axis outside of the plane of the doctor line and the line of support, in which case it is practical for the holder to be mounted on a leaf spring.

It is practical for the elastic pressure-medium hose to be designed and positioned in such a way that it rests against the elastic doctor blade essentially between the lower edge of the doctor knife and the line of support. Since a very extensive area of the pressure-medium hose is accordingly utilized, its resistance to deformation will be of only subordinate significance and can be neglected in relation to adjustment. Furthermore, any inhomogeneities in the pressure-medium hose that result from deflection around the rigidly supported line of support will be completely compensated.

It is practical for the elastic pressure-medium hose to have a triangular cross-section with the apex of the triangle in the vicinity of the line of support. This will additionally reinforce the motion of the lower edge of the doctor blade toward the line of support.

It is practical for the elastic pressure-medium hose to have a protective lip with a sealing action in the vicinity of the line of support to prevent the doctored-off coating medium from penetrating into the longitudinal recess in the cutting beam.

It is also practical for the elastic pressure-medium hose to have an extension to secure it in the longitudinal recess. The extension can be either triangular or rectangular in cross-section for example.

It is practical for the elastic pressure-medium hose to be charged with compressed air although it can also be charged with cold water when it is considered necessary to cool the doctor blade.

It is practical to bed the line of support on a rigid comb strip of a type that is in itself known and with a linear relation to the doctor blade, whereby the rigid comb strip can be adjusted along the line of support in a practical way.

The tension on the doctor blade is adjusted in accordance with the invention by varying the pressure in the elastic pressure-medium hose very sensitively and over a wide range with no change in the configuration of the doctor blade between the doctor line and the line of support so that, in particular, the hydrodynamic pressure ratios are maintained constant.

The doctor blade that is clamped into the device in accordance with the invention can naturally also be employed very practically as the exit lip of a slotted nozzle.

Some preferred embodiments of the invention will now be described with reference to the accompanying drawings, wherein

BRIEF DESCRIPTION OF THE DRAWINGS

FIG. 5 is a schematic partly sectional side view of a third embodiment of a device in accordance with the invention, FIG. 6 is a view similar to FIG. 5 with the doctor blade tensioned, FIG. 7 is a schematic partly sectional side view of a modification of the device illustrated in FIGS. 5 and 6, FIG. 8 is a schematic partly sectional side view of a fourth embodiment of a device in accordance with the invention, and FIG. 9 is a view similar to FIG. 8 with the doctor blade tensioned.

DETAILED DESCRIPTION OF THE PREFERRED EMBODIMENTS

Figure 1:
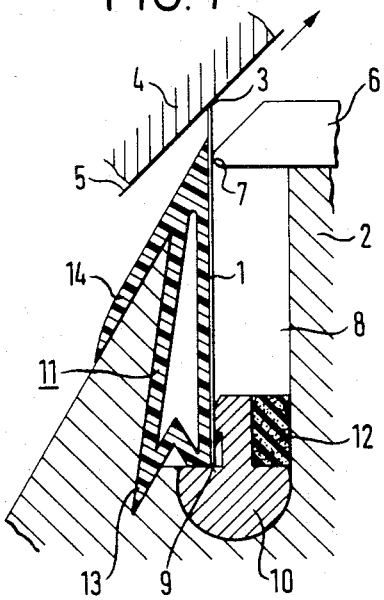
FIG. 1 is a schematic partly sectional side view of one preferred embodiment of a device in accordance with the invention with the doctor blade untensioned.
Figure 2:
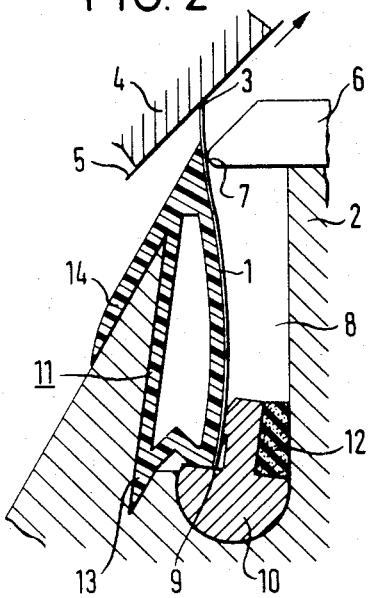
FIG. 2 is a view similar to FIG. 1 with the doctor blade tensioned.

FIGS. 1 and 2 illustrate a preferred embodiment of a device for clamping and tensioning an elastic doctor blade 1 into a cutting beam 2. FIG. 1 shows doctor blade 1 untensioned and FIG. 2 shows it tensioned. Doctor blade 1 rests along a doctor line 3 against a web 5 of material that is to be coated and that runs over a mating roll 4 in the direction indicated by the arrow. Doctor blade 1 is rigidly supported against mating roll 4 along a line 7 of support parallel to doctor line 3 by means of a comb strip 6 positioned on cutting beam 2.

Doctor blade 1 is positioned in a longitudinal recess 8 in cutting beam 2, with its lower edge 9 resting against a rotating element 10 that is mounted eccentric to the plane of doctor line 3 and line 7 of support. A pressure-medium hose 11 that is also positioned in longitudinal recess 8 clamps doctor blade 1 against rotating element 10, tensioning it in cutting beam 2. It is practical for pressure-medium hose 11 to be charged with compressed air, although it can also be charged with cold water when it is considered necessary to cool doctor blade 1. Rotating element 10 itself is supported against an elastic resistance element in the form of a foam rubber element 12 and is rotated against the resistance of the rubber element when pressure-medium hose 11 is charged with pressure medium. The lower edge 9 of doctor blade 1 is simultaneously lifted toward line 7 of support by rotating element 10. It is practical for pressure-medium hose 11 to be essentially triangular in cross-section to reinforce the lifting of the lower edge 9 of doctor blade 1.

Pressure-medium hose 11 has an extension 13, with a triangular cross-section in this case, at the bottom that rests in an appropriately shaped longitudinal groove in the base of longitudinal recess 8 in order to secure pressure-medium hose 11 in the recess. Pressure-medium hose 11 rests against doctor blade 1 between the lower edge 9 of the blade and line 7 of support. Pressure-medium hose 11 has a protective lip 14 with a sealing action in the vicinity of line 7 of support that prevents the coating medium from penetrating into longitudinal recess 8.

Figure 3:
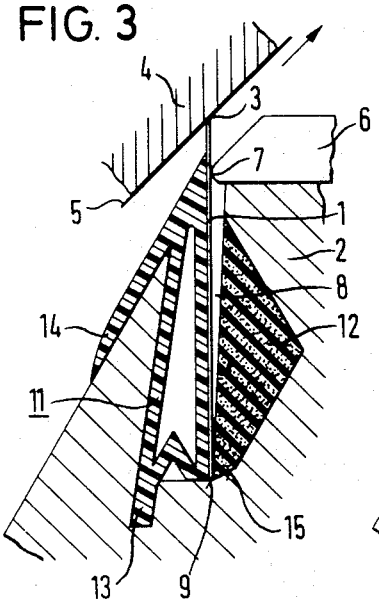
FIG. 3 is a schematic partly sectional side view of another embodiment of a device in accordance with the invention.
Figure 4:
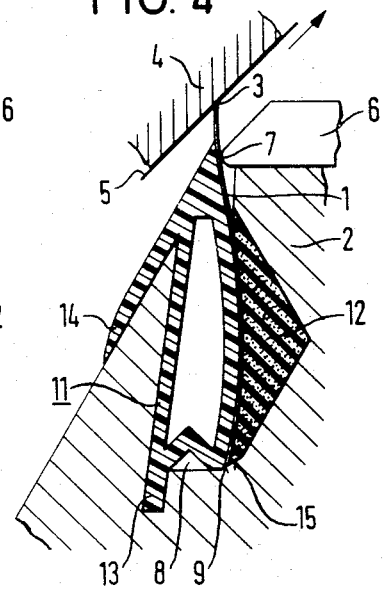
FIG. 4 is a view similar to FIG. 3 with the doctor blade tensioned.

The doctor blade 1 in the embodiment illustrated in FIGS. 3 and 4 is forced by pressure-medium hose 11 directly against an elastic resistance element in the form of a foam rubber element 12*a*. When pressure-medium hose 11 is charged with compressed air, the lower edge 9 of doctor blade 1 is lifted toward line 7 of support by an incline 15 in the base of longitudinal recess 8. The extension 13*e* in this case has a rectangular cross-section.

The lower edge 9 of the doctor blade 1 in the embodiment of the device in accordance with the invention illustrated in FIGS. 5 and 6 rests against an element 17 that lies flat against an incline 16 in the base of longitudinal recess 8 and is forced against element 17 by pressure-medium hose 11 when the latter is charged with compressed air. When adjustments are carried out by varying the pressure in pressure-medium hose 11, element 17 moves against the resistance of an elastic resistance element in the form of an elastic hose 18 along incline 16. The lower edge 9 of doctor blade 1 is accordingly guided out of the plane of doctor line 3 and line 7 of support toward line 7.

FIG. 7 illustrates a variant of the embodiment illustrated in FIGS. 5 and 6 in which the elastic resistance elements are helical springs 19.

Finally, FIGS. 8 and 9 illustrate an embodiment of the device in accordance with the invention in which the lower edge 9 of doctor blade 1 rests on a holder 20 and the blade is forced against the holder by pressure-medium hose 11.

Holder 20 itself is fastened to a leaf spring 21 that is anchored in turn to the base of longitudinal recess 8. When pressure-medium hose 11 is pressurized, holder 20 is pivoted subject to spring tension around pivot axis 22 outside of the plane of doctor line 1 and line 7 of support and the lower edge 9 of doctor blade 1 accordingly guided toward line 7 of support.

It is understood that the specification and examples are illustrative but not limitative of the present invention and that other embodiments within the spirit and scope of the invention will suggest themselves to those skilled in the art.

We claim:

1. In a device for unilaterally clamping an elastically deformable doctor blade into a cutting beam and for varying the force of the blade on a web of material that is to be coated and that runs over a mating roll, wherein the doctor blade rests against the web of material along a doctor line parallel to the cutting beam and is rigidly supported in its midsection along a line of support that is in fixed position with respect to the web of material parallel to the doctor line and the lower edge of the doctor blade can be displaced with respect to the plane of the doctor line and in the line of support, the improvement which comprises (a) providing the cutting beam with a longitudinal recess in which the doctor blade is positioned, (b) providing an elastic pressure-medium hose adjacent one side of the blade to push the doctor blade into the longitudinal recess and providing an elastic resistance in the recess in the cutting beam so as to clamp the blade between the resistance and the elastic pressure-medium hose, and (c) providing means directly abutting the lower edge of the doctor blade for guiding the lower edge of the doctor blade toward the line of support and displacing the lower edge out of a plane defined by the doctor line and the line of support.

2. A device according to claim 1, wherein the guide means for the lower edge of the doctor blade includes a rotating element whose axis of rotation is positioned out of to the plane of the doctor blade and the line of support and that rests and rotates against the elastic resistance element.

3. A device according to claim 1, wherein the guide means for the lower edge of the doctor blade includes a bevel in the base of the longitudinal recess, the doctor blade being supported against the elastic resistance element.

4. A device according to claim 1, wherein the guide means for the lower edge of the doctor blade includes an element that is positioned flat against a bevel in the base of the longitudinal recess and that is supported on an elastic resistance element.

5. A device according to claim 1, wherein the elastic resistance is a foam rubber element.

6. A device according to claim 1, wherein the elastic resistance is an elastic hose.

7. A device according to claim 1, wherein the elastic resistance is a helical spring.

8. A device according to claim 1, where in guide means for lower edge of the doctor blade includes a holder that can be pivoted subject to spring tension around a pivot axis outside the plane of the doctor line and the line of support.

9. A device according to claim 8, wherein the elastic resistance includes a leaf spring on which the holder is mounted.

10. A device according to claim 1, wherein the elastic pressure-medium hose rests against the doctor blade essentially between the lower edge of the doctor blade and the line of support.

11. A device according to claim 1, wherein the elastic pressure-medium hose has an essentially triangular cross-section with the apex of the triangle in the vicinity of the line of support.

12. A device according to claim 1, wherein the elastic pressure-medium hose has a protective lip with a sealing action in the vicinity of the line of support.

13. A device according to claim 1, wherein the elastic pressure-medium hose has an extension to secure it in the longitudinal recess.

14. A device according to claim 1, wherein the elastic pressure-medium hose is charged with compressed air.

15. A device according to claim 1, wherein the elastic pressure-medium hose is charged with cold water.

16. A device according to claim 1, including a rigid comb strip extending the length of the doctor blade and establishing the line of support.

* * * * *